United States Patent [19]

Sato

[11] Patent Number: 5,041,021

[45] Date of Patent: Aug. 20, 1991

[54] ELECTRICAL CONNECTOR

[75] Inventor: Kensaku Sato, Tokyo, Japan

[73] Assignee: Hirose Electric Co., Ltd., Tokyo, Japan

[21] Appl. No.: 612,925

[22] Filed: Nov. 14, 1990

[30] Foreign Application Priority Data

Dec. 11, 1989 [JP] Japan ..... 1-142069

[51] Int. Cl.[5] ..... H01R 17/04

[52] U.S. Cl. ..... 439/585; 439/610

[58] Field of Search ..... 439/98, 610, 607, 99, 439/585, 675

[56] References Cited

U.S. PATENT DOCUMENTS

| | | | |
|---|---|---|---|
| 3,302,159 | 1/1967 | Schumacher | 439/675 |
| 4,737,124 | 4/1988 | Ezure et al. | 439/610 |
| 4,810,210 | 3/1989 | Komatsu | 439/610 |
| 4,884,984 | 12/1989 | Matsumoto | 439/877 |
| 4,954,097 | 9/1990 | Sekiguchi | 439/610 |

FOREIGN PATENT DOCUMENTS

| | | | |
|---|---|---|---|
| 1077744 | 3/1960 | Fed. Rep. of Germany | 439/607 |

*Primary Examiner*—Gary F. Paumen

*Attorney, Agent, or Firm*—Kanesaka & Takeuchi

[57] ABSTRACT

An electrical connector for a shield cable which includes a shield sleeve portion (3) including a contact portion (6) having a pair of opposed jig entrances (10,11), a shield wires crimping portion (7) having a pair of crimping tabs (12), and an outer sheath crimping portion (8) having a pair of crimping tabs (13); and a signal line contact (5) having a contact body (14) and a pair of crimping tabs (17) to which a signal line of the shield cable is to be connected by crimping, said signal line contact being placed within the contact holding portion via an insulation body so that the crimping portion is positioned between the jig entrances.

4 Claims, 5 Drawing Sheets

ELECTRICAL CONNECTOR

BACKGROUND OF THE INVENTION

1. Field of the Invention

The present invention relates to a connector for shield cables of electronic controls in an automobile for example.

2. Description of the Prior Art

FIG. 12 shows a conventional connector of this type which is made by removing a length of outer sheath g of a shield cable a; separating a shield wires b from a signal line c, bundling and connecting the shield wires b and the signal line c to the contact terminal e and the insulation displacement terminal f of a connector body d, respectively.

However, the removal of the outer shield g, the separation of the shield wires b from the signal line c, and the direction of the signal line b and the signal line c to the contact terminals e and f have been made by hands. The shield wires b and the signal line c have been connected separately to the contact terminals e and f by bundling the shield wires b while using the insulation displacing technique for the signal line c. Consequently, it has been difficult to streamline and automate the connection operations. In addition, the signal line c from which the shield wires b were removed has been susceptible to electromagnetic interferences.

SUMMARY OF THE INVENTION

Accordingly, it is an object of the invention to provide a connector which permits simultaneous connection by crimping of the signal line, intermediate insulator, shield wires, and outer sheath of a shield cable, thereby making possible continuous and automatic connection of a large number of connectors.

It is another object of the invention to provide a connector which has the enhanced shielding effect.

According to the invention there is provided an electrical connector for a shield cable which includes a shield sleeve portion including a contact holding portion having a jig entrance extending forwardly from a rear edge thereof, a shield wires crimping portion having a pair of crimping tabs, and an outer sheath crimping portion having a pair of crimping tabs; and a signal line contact having a contact body and a pair of crimping tabs to which a signal line of the shield cable is to be connected by crimping and placed within the contact holding portion via an insulation body so that the crimping portion is positioned within the jig entrance.

The stripped front end of a shield cable is placed on the electrical contact such that the signal line, intermediate insulator, shield wires, and outer sheath are positioned on the respective crimping tabs and simultaneously pressed with a crimping tool onto the crimping tabs for effecting connection, making possible continuous and automatic connection of a large number of connectors. The shield sleeve fully covers the signal line and the signal line contact, thus providing an excellent shielding effect.

The above and other objects, features, and advantages of the invention will be more apparent from the following description when taken in conjunction with the accompanying drawings.

DESCRIPTION OF THE PREFERRED EMBODIMENT

Figure 1:
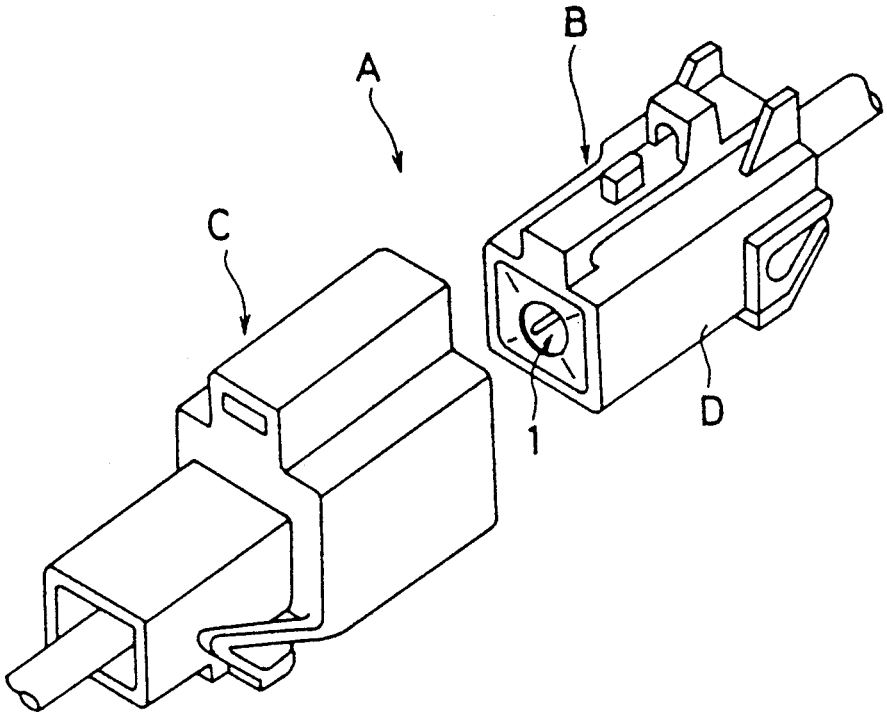
FIG. 1 is a perspective view of a connector according to an embodiment of the invention before coupling.
Figure 12:
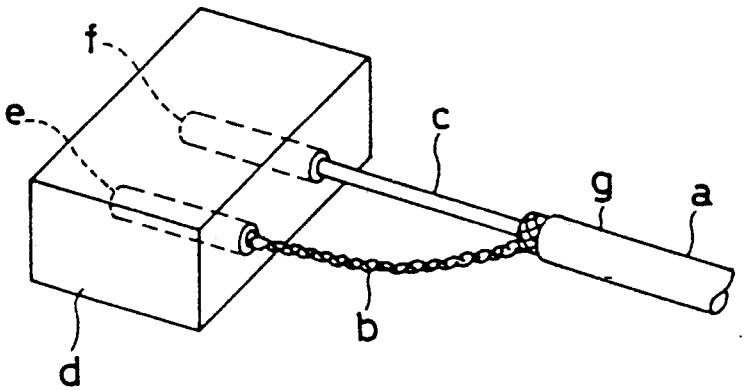
FIG. 12 PRIOR ART
FIG. 12 is a perspective view of a conventional connector.

FIG. 1 shows a connector according to an embodiment of the invention before coupling. A connector A consists of a female connector B and a male connector C. The female connector B includes a housing D and an electrical contact terminal 1 therein.

As FIGS. 2–9 show, the electrical contact terminal 1 has a shield sleeve 3, an insulation body 4, and a signal contact 5. The shield sleeve 3 is divided into three portions; a tubular holder portion 6, a shield wires crimping portion 7, and a sheath retention portion 8. Behind the contact holder portion 6 there are jig entrances 10 and 11. The jig entrance 10 extends forwardly from the rear edge 6*a* of the contact holder portion 6. The shield crimping portion 7 has a pair of crimping tabs 12 forming a U-shaped cross section. The sheath retention portion 8 also has a pair of crimping tabs 13 forming a U-shaped cross section. The crimping tabs 13 are greater than the crimping tabs 12.

The signal line contact 5 is divided into three portions; a contact body 14, a signal line crimping portion 15, and an insulator crimping portion 16. The contact body 14 has the form of a pin while the signal line crimping portion 15 consists of a pair of crimping tabs 17. The insulator crimping portion 16 has a pair of crimping tabs 18 forming a U-shaped cross section. The signal line contact 5 is supported by the insulator 4 within the contact holder portion 6 of the contact terminal 1 such that the signal line crimping portion 15 and the insulator crimping portion 16 are placed in the jig entrance 10 and 11, respectively.

Figure 2:
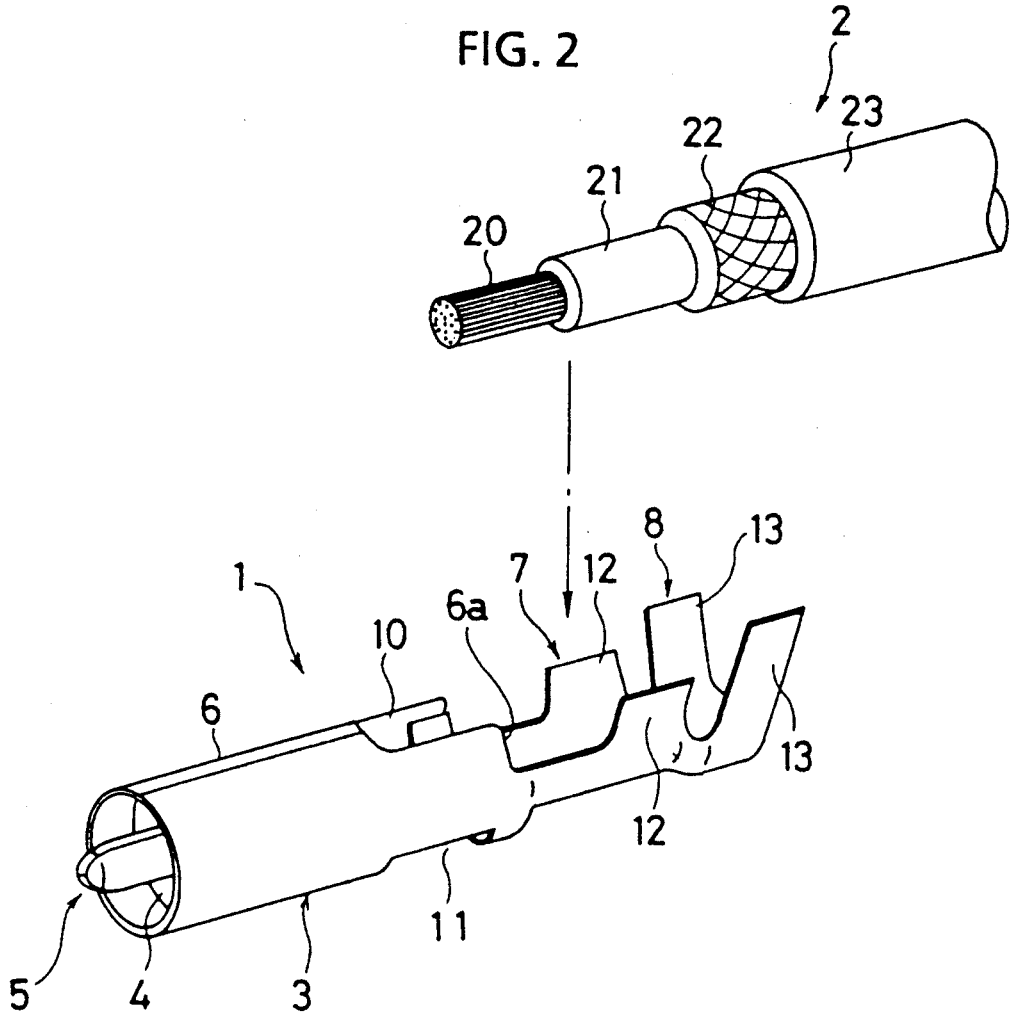
FIG. 2 is a perspective view of an electrical contact terminal of the connector.
Figure 3:
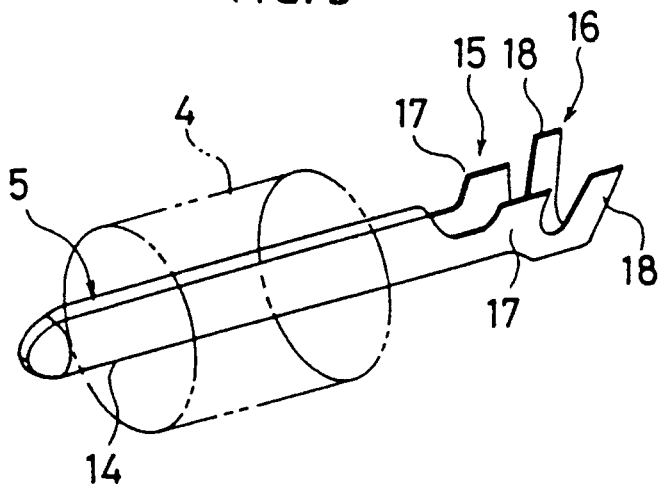
FIG. 3 is a perspective view of a signal line contact of the connector.
Figure 4:
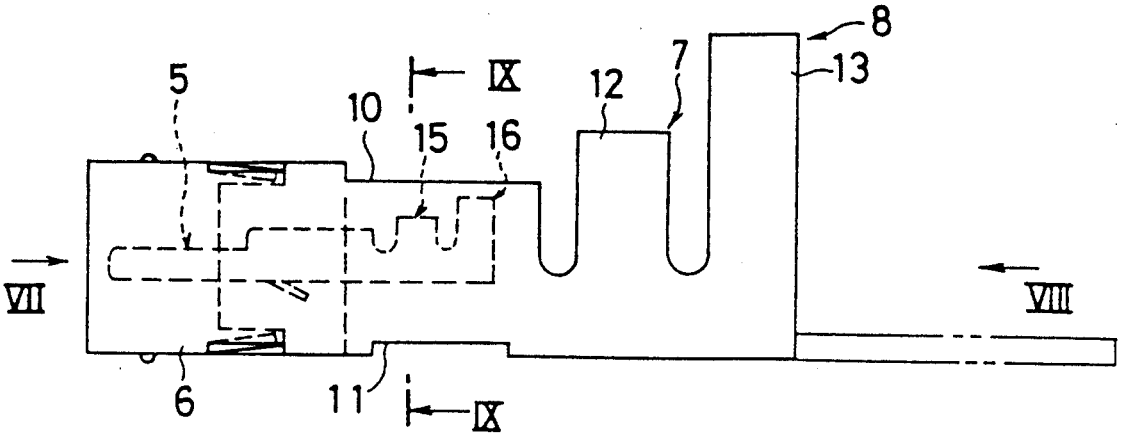
FIG. 4 is a side elevation of the electrical contact terminal.
Figure 5:
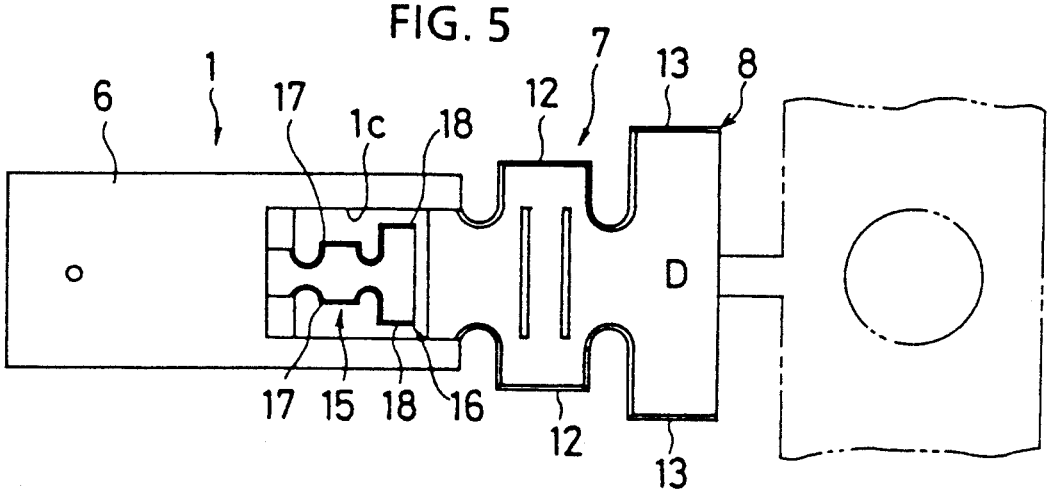
FIG. 5 is a top plan view thereof.
Figure 6:
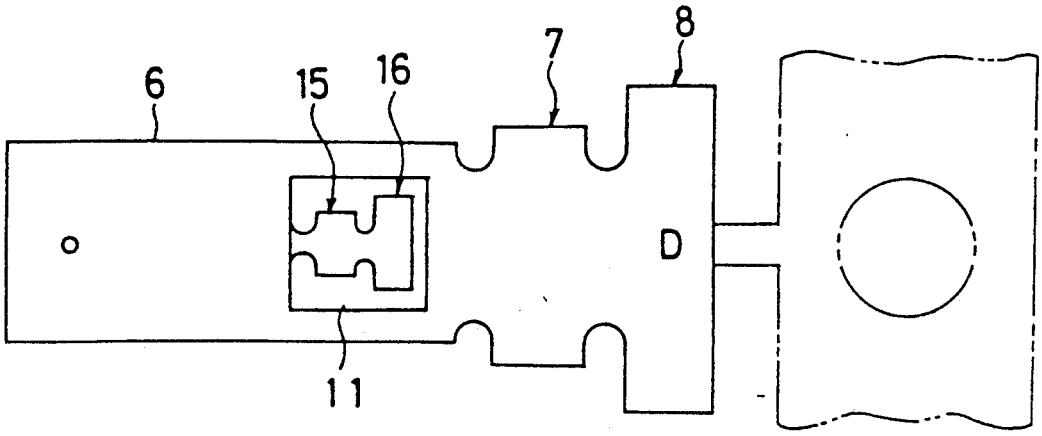
FIG. 6 is a bottom plan view thereof.
Figure 7:
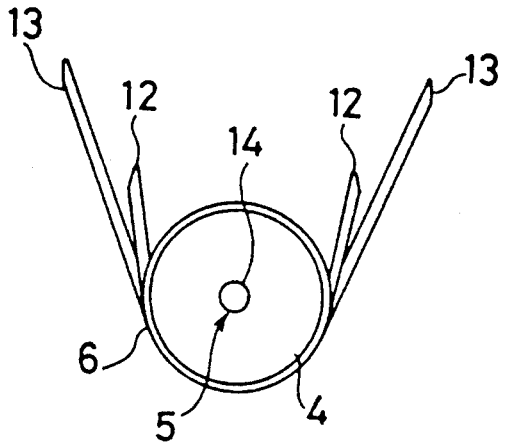
FIG. 7 is a front elevation thereof viewed from the arrow VII—VII of FIG. 4.
Figure 8:
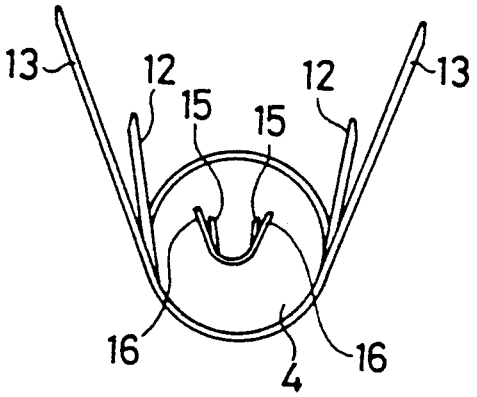
FIG. 8 is a rear elevation thereof viewed from the arrow VIII—VIII of FIG. 4.
Figure 9:
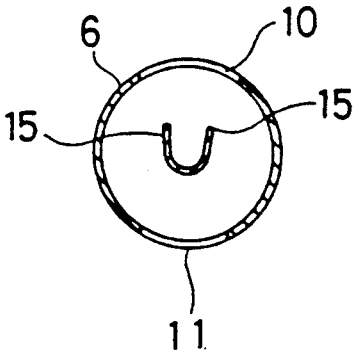
FIG. 9 is a sectional view taken along the line IX—IX of FIG. 4.

In order to connect the shield cable 2 to the contact terminal 1, as FIG. 2 shows, a length of outer sheath 23 of the shield cable 2 is removed to expose the signal line (central conductor) 20, the intermediate insulator 21, and the shield wires (outer conductor) 22. The shield cable 2 is placed on the contact terminal 1 such that the signal line 20, the intermediate insulator 21, the shield wires 22, and the outer sheath 23 are positioned at the signal line crimping tabs 17, the crimping tabs 18 of the insulator crimping portion 16, the crimping tabs 12 of the shield wires crimping portion, and the crimping tabs 13 of the sheath holder portion 3, respectively.

Figure 10:
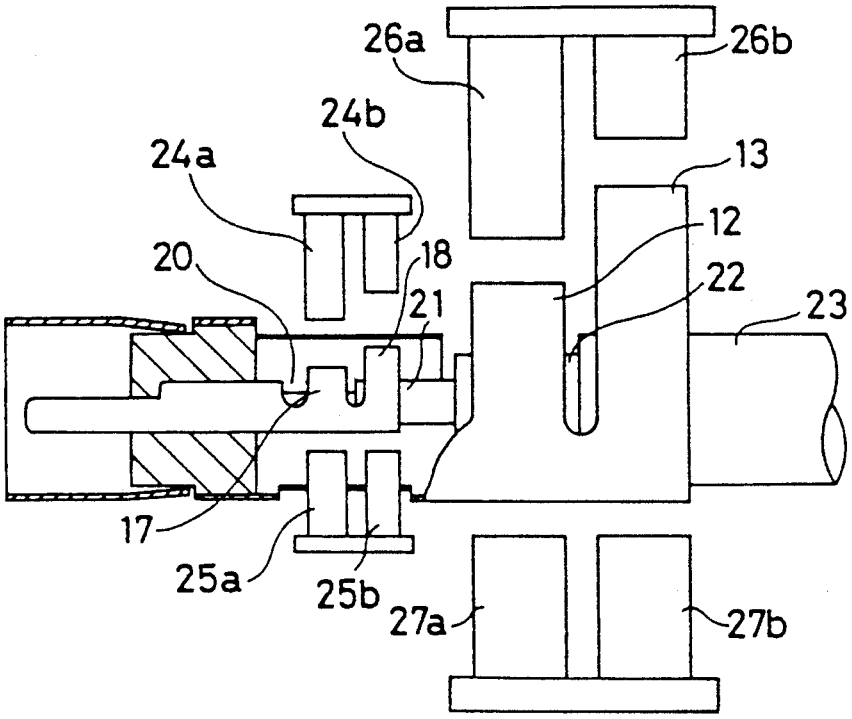
FIG. 10 illustrates how to crimp a shield cable to the electrical contact terminal.
Figure 11:
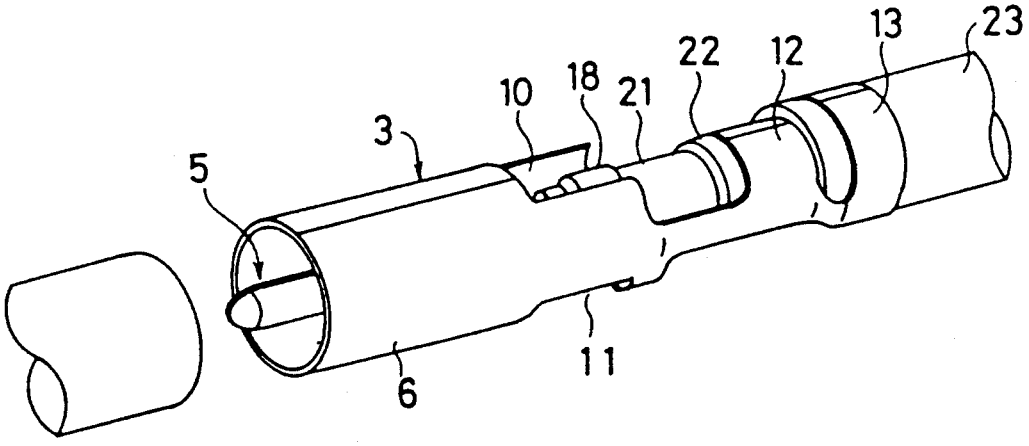
FIG. 11 illustrates the electrical contact terminal to which the shield cable has been crimped.

As FIG. 10 shows, the signal line 20, the intermediate insulator 21, the shield wires 22, and the outer sheath 23 are simultaneously connected to the signal line crimping tabs 17 and the other crimping tabs 18, 12, and 13 by crimping techniques, respectively, by means of anvils 24*a*, 24*b*, 26*a*, and 26*b*, and crimpers 25*a*, 25*b*, 27*a*, and 27*b* which are crimping tools. More specifically, the signal line anvils 24*a* and 24*b* and the crimpers 25*a* and 25*b* are inserted through the jig entrances 10 and 11, respectively, to press the signal line crimping tabs 17 and the insulator crimping tabs 18 for simultaneous connection of the signal line 20 and the intermediate insulator 21. In addition, the crimping tabs 12 and 13 are crimped to the shield wires 22 and the outer sheath 23 with the crimping anvils 26*a* and 26*b* and the crimpers 27*a* and 27*b*, respectively, to connect the shield cable 2 to the electrical contact 1. The electrical contact 1 is then inserted and fixed in the housing D to form a female connector B, which is coupled to the male connector C for making electrical connection.

As has been described above, with the connector according to the invention, it is possible to simultaneously connect the signal line, the intermediate insulator, the shield wires, and the outer sheath to the respective crimping tabs with crimping tools. This makes continuous connection of a large number of connectors possible and thus automation of the operation possible. The coverage by the shielding sleeve of the signal line and signal line contact increases and thus the shield effect.

I claim:

1. An electrical connector for a shield cable comprising:

a shield sleeve portion including a contact holding portion having a pair of opposed jig entrances, a shield wires crimping portion having a pair of crimping tabs, and an outer sheath crimping portion having a pair of crimping tabs; and a signal line contact having a contact body and a crimping portion with a pair of crimping tabs to which a signal line of said shield cable is to be connected by crimping, said signal line contact being placed within said contact holding portion via an insulator body so that said crimping portion is positioned between said jig entrances, said jig entrances being large enough to accept crimping tools so as to allow said shield wires crimping portion and said signal line crimping portion to be simultaneously crimped.

2. An electrical connector for a shield cable comprising:

a shield sleeve portion which includes a cylindrical contact holding portion having a pair of opposed jig entrances and a U-shaped shield wires crimping portion having a pair of crimping tabs;

a cylindrical insulation block fitted in said cylindrical contact holding portion; and a signal line contact having a U-shaped signal line crimping portion and a cylindrical contact portion fitted through said insulation block such that said signal line crimping portion is aligned with said jig entrances, said jig entrances being large enough to accept crimping tools, whereby said signal line crimping portion and said shield wire crimping portion can be simultaneously crimped by said crimping tools.

3. The electrical connector of claim 2, wherein said shield sleeve portion further includes a U-shaped outer sheath crimping portion having a pair of crimping tabs so that said signal line crimping portion, said shield wire crimping portion, and said outer sheath crimping portion can be simultaneously crimped.

4. The electrical connector of claim 3, wherein said signal line contact further having a U-shaped insulator crimping portion having a pair of crimping tabs so that said signal line crimping portion, said insulator crimping portion, said shield wire crimping portion, and said outer sheath crimping portion can be simultaneously crimped.

* * * * *